United States Patent [19]

Steenbock

[11] 4,442,908

[45] Apr. 17, 1984

[54] TOOL FOR DRILLING CURVED SECTIONS OF WELL HOLES

[75] Inventor: Arno Steenbock, Barsinghausen, Fed. Rep. of Germany

[73] Assignee: Preussag Aktiengesellschaft, Fed. Rep. of Germany

[21] Appl. No.: 281,334

[22] Filed: Jul. 8, 1981

[30] Foreign Application Priority Data

Jul. 12, 1980 [DE] Fed. Rep. of Germany ..... 3026559
Mar. 3, 1981 [DE] Fed. Rep. of Germany ..... 3107973

[51] Int. Cl.[3] ..... E21B 7/08

[52] U.S. Cl. ..... 175/74; 175/61; 175/73

[58] Field of Search ..... 175/74, 61, 73, 325, 175/76

[56] References Cited

U.S. PATENT DOCUMENTS 2,016,042 10/1935 Lewis ..... 175/325 X
2,743,082 4/1956 Zublin ..... 175/61
2,819,040 1/1958 James et al. ..... 175/325 X
2,829,864 4/1958 Knapp ..... 175/61 X
3,156,310 11/1964 Frisby ..... 175/325 X
4,143,722 3/1979 Driver ..... 175/61 X
4,185,704 1/1980 Nixon ..... 175/325 X

*Primary Examiner*—James A. Leppink
*Assistant Examiner*—Michael J. Starinsky
*Attorney, Agent, or Firm*—Allegretti, Newitt, Witcoff & McAndrews, Ltd.

[57] ABSTRACT

A drilling tool for deep wells having a motor-driven drill bit which can be turned at an angle to the axis of the primary well hole to produce lateral holes branching from the primary hole. The bit is rotatably-mounted in the last in a series of pivotally articulated links at the downhole end of the drill pipe string. The deviation of the drill bit from the well axis is controlled by pivoting the last link with respect to the penultimate link. The last link includes a sliding surface which bears against the wall of the well hole to effect the pivoting. In another form of the invention a spring effects the pivoting. Preferably stops are provided between the last and penultimate link to limit the angle of pivoting.

13 Claims, 8 Drawing Figures

II
III

TOOL FOR DRILLING CURVED SECTIONS OF WELL HOLES

The present invention relates to a tool for drilling horizontal shafts from a deep vertical well hole, and more particularly to means for turning the drill bit from the vertical, said means comprising part of an assembly of articulated links between said bit and the uphole portion of the drill pipe train.

THE PRIOR ART

From the article "Improved Directional Drilling Will Expand Use" by McDonald et al. in the *Oil and Gas Journal,* Feb. 26, 1979, and the therein cited reference "Dyna-Drill Handbook"; 2nd Ed. of Smith International, Inc., it is known to use a so-called "bent sub" in the drilling of a curved hole from a vertical well. Such bent sub has the effect of producing a small rigid angular deviation of the downhole end of the drill string. Disposed in the deviated or turning section of the drill string is a power drive for the drill bit which is attached to the lower end of the drill pipe string. Due to this deviation, the bent sub causes a lateral bias or turning of the drill bit. It is assumed that this will produce a continuous controlled deviation of the drilling tool during the course of the drilling operation. However, since the drill pipe string, the bent sub and the portion of the drill pipe string below the bent sub, which includes the downhole drive system, are substantially rigid and the deviated section is relatively long, the actual angular deviation is small, so that large angle turns are attainable only by by traversing long distances. The aforementioned article states that at bent sub angles of 0.5° to 2° deviations of only 5° per one hundred feet are attainable.

In actual practice it is desirable to produce substantially greater deviations, i.e. sharper turns. The McDonald article cites deflections of up to 90° as being desirable at a vertical depth of 300 to 600 meters. It says that this will require specialty tools, but fails to describe such tools in more detail. At the end of the article it is pointed out that many of such specialty tools and structural elements are not available and still need to be developed.

The McDonald article also describes so-called "whipstocks" used in the directional drilling of well holes. According to this article, a "whipstock" is essentially a long concave steel wedge by which the drilling assembly is supported and guided. The whipstock is rigidly anchored in the well hole and the drill bit is angularly deflected by the wedge-shaped surface area of the whipstock in the direction the curved hole is to be drilled. This technique likewise produces only small angles of deflection. It is stated that this mode of operation is expensive and recommended only where other techniques have failed.

Further, the aforementioned article points to the possibility of obtaining a lateral deviation of the drill pipe by subjecting it to laterally-directed fluid jets. It is stated that this procedure is applicable only where very soft sediments are involved. An additional disadvantage is is that only very small angles of deviation are attainable because of the rigidity of the drill pipe.

Finally, reference is made in the above article to a commercial brochure of Eastman-Whipstock, Inc. of Houston, Tex., describing a so-called "knuckle joint". Such knuckle joint is a spring loaded universal ball joint mounted in the drill pipe to permit a certain amount of deviation of the downhole end of the drill pipe to form an angle with the drill pipe portion above the bend. It is pointed out that, unless a whipstock is used, no controlled directional deviation is possible since the orientation of the equipment is unpredictable. Accordingly, equipment of this type is practically no longer in us today.

U.S. Pat. No. 4,143,722 discloses a downhole drive system comprising a plurality of individual electric motors axially aligned in tubular members which are connected to each other by flexible tubes. The motors are coupled to each other by flexible shafts. This flexible downhole drive system, in conjunction with a whipstock, produces a curved hole extending from a vertical well hole. Without the use of the cumbersome whipstock, no angular deflection is attainable. The drill string is rotated to stabilize the flexible drive system after its passage through the bend to prevent it from flexing. However, stabilization by rotating the drill pipe is inadequate in view of the extremely low rotational speed. Moreover, it is impossible to prevent the drill attached to the flexible members of the downhole drive system from being lowered by gravity or deflected in other directions in response to various forces arising during the drilling operation. All in all, the drilling direction of this known drilling tool is largely uncontrollable; at best, it might be said to be controllable within excessively wide limits.

French Pat. No. 12 47 545 discloses a drilling tool of a similar type, in which a slightly-deflectable member is provided below the downhole drive system. This member encloses the shaft of the drill bit and is provided uphole and downhole with inflatable rubber elements to effect a lateral thrust on the drill bit. However, the well hole deviations obtained by this device are small, and must be so by necessity, because of the limitations imposed by the non-elastic nature of the lower end of the rigid drill string pipe.

It is generally true of all prior drilling equipment that due to the particular construction of the drill pipe, the radii of curvature are relatively large, so that deviations of, say, 90° are attainable only by traversing vertical depths on the order of 600 to 1000 meters. To reduce the total drilling distance, it is known to drill several branch holes from a single vertical well hole. However, in view of the large radii of curvature, the savings in terms of total drilling distance are relatively small.

For these reasons it is desirable in mining a weak seam containing hydrocarbons to drill horizontal shafts radiating from a vertical well hole having the smallest possible radius of curvature.

THE INVENTION

It is the object of the present invention to provide a tool for drilling turned deep well hole sections having a relatively small radius of curvature.

This object is achieved by providing an articulated drill pipe string comprising link members pivotally connected to turn in one plane only. The angle of deviation is controlled by limiting the angle which the last downhole member makes with the penultimate member. The drill bit is mounted in a bearing in said last downhole member and therefore turns as said member pivots.

In contrast to the state of the art, according to which a rigid and non-rotatable drill pipe enclosing a downhole drive system makes a small angle with the drill pipe section above it, or a rotatable drill pipe is provided with a universal joint producing an uncontrollable drilling direction, the present invention is the first to use a flexible drill string pipe which is flexible in one plane only and is capable of producing relatively sharp turns or deviations. The plane of deviation (direction of the branch shaft from the vertical hole) may be established by the rotational position of the drill string pipe which is controllable from above ground. The portion of the drill pipe uphole of the rotatable portion may be largely rigid, if desired.

By means of a tool constructed according to the invention, the efficient and economical mining of an underground deposit is made possible by means of a plurality of holes or branches drilled in a star-like pattern radiating from the centrally-located well hole. Such branch holes may either have a precisely controlled angular deviation, or they may extend horizontally.

The flexibility of the drill pipe in one plane only is achieved in that the link members of the flexible drill pipe are connected to each other by pivot pins the axes of which are parallel. These pivots enable the individual link members to be so precisely oriented in the plane of deflection that any inappropriate lateral deviation which tends to be caused, for example, by reacting forces arising from the drill bit or the like, is prevented, even if the flexible drill pipe is comparatively long.

Since the last two link members of the articulated drill pipe closest to the drill bit are critical for a successful drilling operation, means are provided which determine the angular position of these two members with respect to each other in the plane of deviation, and hence prescribe the drilling direction of the bit, which is mounted on said last member. It is within the scope of the present invention to define the angular position of either the last link member with respect to the next to the last member, or the angular position of the next to the last member with respect to the last member. The penultimate member may serve as a point of reference. To enable the penultimate link member to occupy a defined position in the well hole, the invention provides that the width of the penultimate member, at least in the plane of deviation, be equal to the diameter of the drill bit. Thus, the penultimate member is in close contact with the wall of the well and is guided thereby so that its position and the position of the pivot between the two members is essentially defined.

In accordance with the invention there are several constructions for controlling the pivotal position of the last two link members of the drill pipe, and thus the direction of the drill bit mounted on the last member.

In one construction the last member is provided with a runner formed in a face of the member which bears against the wall of the hole being drilled. The runner is spaced from a plane, defined by the rotational axis of the drill bit and the pivot axis normal thereto, a distance slightly greater than the radius of the drill bit or the drilled hole. Thus the drill bit is urged out of its natural path determined essentially by its rotational axis, with the result that the angular position of the last link member carrying the drill bit is established with respect to the guided penultimate drill string member. If the pivot axis is off center and is displaced toward the outer rim of the bend, the distance of the runner from the axis of the drill bit may be correspondingly smaller. This distance depends also on the longitudinal distance between the runner and the drill bit. These geometric relationships are readily apparent to those skilled in the art from the disclosure based on the invention.

Another construction controlling the angular position of the last link member of the drill pipe with respect to the penultimate member provides a pivot axis between the last and the penultimate member which is off center, and a stop is provided between the two members to limit the tilting movement in the direction of deviation caused by the eccentricity of the pivot axis in combination with the axial thrust of the drill bit. It will be noted that in this embodiment, the angle between the last two link members of the drill pipe and hence the angular extent of the bend of the drilled hole is a function of the drilling thrust which is controllable. Consequently, by controlling the drilling pressure or thrust, it is possible to also control in some measure the angle of the bend being drilled.

Another construction for controlling the angle between the last two drill pipe members is to provide a compressed spring between said members to urge the last member in the direction of the desired bend. In this construction the angular position is independent of the shape of the surrounding well hole so that it is possible to commence drilling of a sharply curved branch or hole from any point in a straight well hole. In consequence thereof, a plurality of holes may be drilled from a vertical well in a radiating patter into, e.g., a horizontal layer, without the use of wedges, whipstocks or the like.

According to another embodiment of the invention, the individual link members of the drill pipe are comprised of tubular sections or pipes in a overlapping relationship to each other in the region of the pivot axes. This produces a smooth exterior of the drill pipe which will help ease the advance movement into and the retraction from a curved hole. It is particularly beneficial if the members are tightly fitted so that they may form a conduit for drilling fluids fed to the drill bit.

In a further embodiment of the invention, a shaft segment of a flexible drive shaft for powering the drill bit is rotatably mounted within each link member of the string, and shaft segments are connected to each other by universal joints in the regions of the pivot axes.

A modification of the embodiments, in which the angle between the last two link members is produced either by means of a runner-like element provided on the last member or by a spring disposed between the two last members, provides for the adjacent members to have mutually-interfacing stops to limit the movement of the members in the direction of the bend. In this manner, the angular configuration of the completed curve or bend can be precisely defined.

The flexible drill pipe string according to the invention lends itself to bending from a straight line into both directions of its plane of flexibility. In actual practice, however, it is preferred to have the drill string bending in one direction only. For this reason, a further embodiment of the invention provides for additional interfacing stops on the members to keep the members from moving in a direction opposite the desired direction of curvature.

In accordance with another teaching of the invention, the downhole drive is disposed between the flexible drill pipe string and the adjacent, essentially rigid portion thereof. The drill bit is connected to the downhole drive system by a flexible drive shaft which consists of individual shaft members and is threaded through the flexible drill string. In this manner, the construction of the drive system is simplified.

It is also possible to arrange the drive system between the flexible drill string portion and the drill bit so as to eliminate a flexible shaft. In this case, the downhole drive advantageously consists of a plurality of motors arranged in casings corresponding to the members of the flexible drill string and whose drive shafts are connected by universal joints. This minimizes the number of flexible couplings between the individual motors.

THE DRAWINGS

The invention will be described in further detail with reference to the accompanying drawings, in which.

Figures 1, 2, 3, 4, 5:
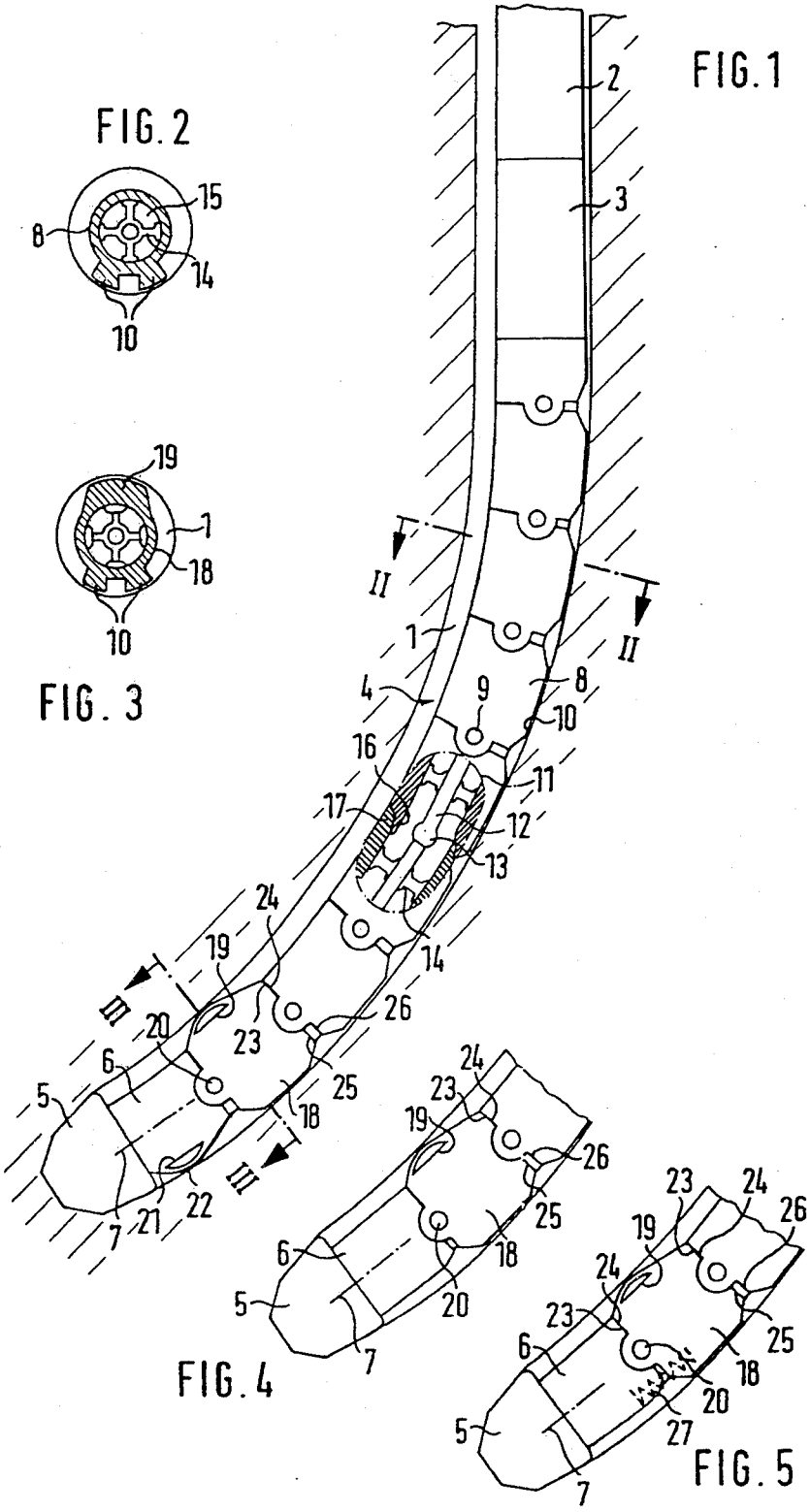
FIG. 1 is a schematic sectional view of a portion of a curved well hole having a tool according to the invention inserted therein.
FIG. 2 is a sectional view along the line II—II of FIG. 1.
FIG. 3 is a sectional view along the line III—III of FIG. 1.
Figure 6:
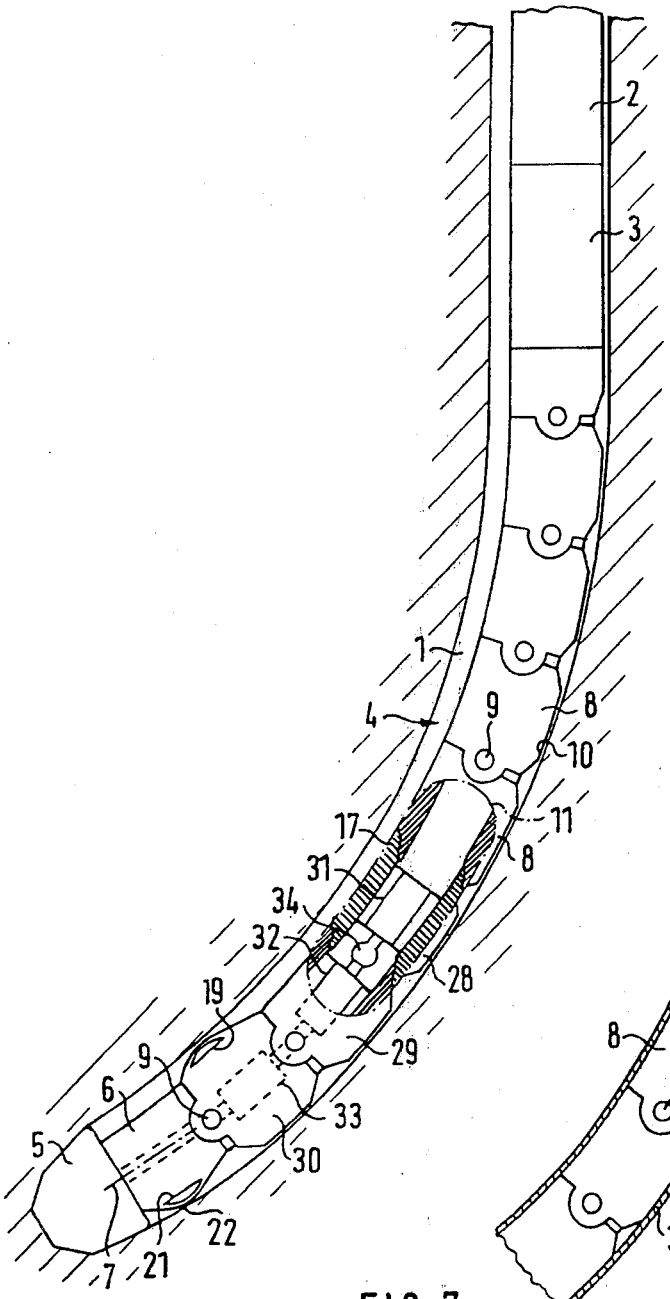

FIG. 4 corresponds to the lower portion of FIG. 1 and illustrates another embodiment of the invention;

FIG. 5 is similar to FIG. 4 and illustrates a further embodiment of the invention;

FIG. 6 is similar to FIG. 1 and illustrates an embodiment of the invention in which a downhole drive is disposed between the drill bit and the flexible drill string;

and

Figure 7:
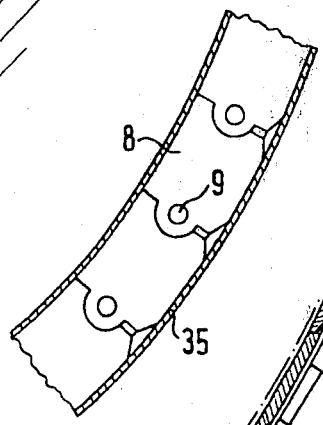
Figure 8:
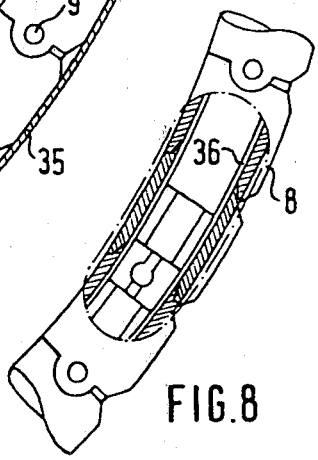

FIGS. 7 and 8 are partial views of FIG. 6 and illustrate a modification incorporating a sealing casing.

DETAILED DESCRIPTION

FIG. 1 represents a sectional view of a well hole 1 having inserted therein a tool according to the invention which is attached to the lower end of a vertical non-rotatable and angularly adjustable drill pipe string. The tool consists of a downhole drive 3 which is secured to the drill pipe string 2 and may, for instance, be a turbine. The downhole drive 3 is connected to a drill bit 5 by means of an articulated flexible drill string 4 comprising a series of link members. The drill bit 5 is supported in a pivot bearing, not illustrated, provided on the last link member 6 of the flexible drill string 4. The axis 7 of the drill bit 5 is designated by dash-dotted lines.

The individual link members 8 of the flexible drill string are pivotally connected to each other by pivot pins 9 to enable them to move with respect to each other in one plane only which corresponds in the embodiment of FIG. 1 to the plane of the paper. The dimensions of the members 8 are somewhat smaller than the dimension of the well hole 1 so that they may be readily moved forward and backward in the curved region of the well hole 1. As will be seen from FIG. 2, which is a sectional view along the line II—II of FIG. 1, the member 8, like the other members, is of a generally tubular configuration. On one side it has two longitudinal elements or runners 10 to enable the member 8 to engage the outer side wall in the curved section of the well hole 1 due to the effect of the drilling pressure. The runners 10 enable the members 8 to slide on the wall of the hole with a minimum amount of friction. Moreover, due to spacing between the runners, sufficient room is created for the return flow of drilling fluids.

The interior of the members 8 is shown in a partially broken away oval section 11 of FIG. 1. It will be seen that a flexible drive shaft extends through the members 8. The drive shaft consists of segments 12 which are connected to each other by universal joints 13 in the regions of the pivot axes. The shaft segments 12 are mounted in star-shaped or spoked bearings 14, as shown in FIG. 2, to create a passage 15 for drilling fluids. The individual members closely overlap each other by lips 16 and throwovers 17 on a substantially spherical surface so as to produce a closed flexible conduit for the drilling fluid.

The next to the last link member 18 of the flexible drill string 4 is substantially of the same construction as the preceding members. However, the member 18 is provided with an additional runner 19 opposite runners 10 which slide over opposite side of the well hole. The distance between the faces of the opposed runners corresponds substantially to the largest diameter of the drill bit 5, or the well hole 1 so that the position of the member 18, and hence the position of the pivot axis 20 between the last members, are defined with respect to the well 1. This is clearly shown in FIG. 3 which is a sectional view along the line III—III of FIG. 1.

The last link member 6 of the drill string is provided with an abutting or sliding surface 22 in the form of a runner 21 located in the region of the outer rim of the bend and opposite the runner 19. The abutting surface 22 is spaced from the axis 7 of the drill bit 5 at a distance which is somewhat larger than the radius of the drill bit 5. This causes the last link member 6 and also the drill bit 5 connected thereto to be pushed into an inclined position with respect to the member 18. This inclination is necessarily maintained during drilling so that the particular curve of the hole is continued as the drilling advances.

When the desired direction the drill bit 5 is to take has been established, subsequent drilling in the branch hole may be effected with the assistance of a flexible drill pipe section, like the flexible drill pipe 4, from which the last member 6 has been removed or the runner 21 thereon has been omitted so that it is square with the member 18, i.e. forms an angle of 0° therewith and the direction of drilling is a straight line.

Cooperating stops 23 and 24 are provided between the members 6 and 18 or 8 and 18 at the inner rim of the bend to limit the angle of deviation and define the maximum possible curvature. On the outer rim of the bend are provided stops 25 and 26 which are spaced from each other a distance such that the flexible drill string 4 is prevented from moving away from the desired curve to a straight path.

FIG. 4 shows the lower end of the assembly illustrated in FIG. 1, and like parts are designated by the same reference numerals. In contrast to the embodiment according to FIG. 1, however, the pivot axis between the last member 6 and the penultimate member 18 is located off center, i.e., it is offset toward the outer rim of the bend. In this manner, the drilling thrust exerted upon the axis 7 produces a torque which causes the member 6 to tilt in the desired direction of the curve until the stops 23 and 24 abut each other. Also in contrast to the embodiment of FIG. 1, here the runner 21 with its abutting surface 22 thereon has been omitted from the member 6.

FIG. 5 like FIG. 4 shows the lower portion of the assembly illustrated in FIG. 1, with like parts designated with like reference numerals. In contrast to FIG. 1, the embodiment of FIG. 5 omits the runner 21 with the abutting surface 22 thereon, and in its place uses a compression spring 27 disposed at the outer edge of the pivot axis 20, when viewed with reference to the bend. The compression spring 27 causes the member 6 to tilt with respect to the member 18 independently of the drilling thrust and urges the stops 23 and 24 against each other.

If the embodiments of FIGS. 1 and 4 are utilized in branch drilling from a vertical well, it may be expedient to use a wedge known per se to get the deflection process started. In the embodiment of FIG. 5, such a wedge is not necessarily required, because the spring 27 is effective to push the downhole end of the drill string sideways and thereby start the directional drilling of a hole from a vertical well.

While the view of FIG. 6 is similar to FIG. 1, it illustrates a different embodiment of the invention. In the embodiment of FIG. 6, the drive assembly consisting of motors 31, 32 and 33 housed in members 28, 29 and 30 is positioned between the drill bit 5, or the member 6, and the members 8 of the flexible drill string 4, which members are connected to each other by pivot pins 9. In this particular construction, the flexible shaft extending through the drill string members is no longer required. Hence, both the structural expenditure and the rate of wear are reduced. The drive shafts of the individual motors 31, 32 and 33 are connected to each other by universal joints 34. The motor 33 facing the drill bit 5 is connected to the drive shaft of the drill bit 5 by a universal joint which is similar to the universal joint 34 but which is not visible in FIG. 6 since it is hidden behind the pivot 9. The members 28, 29, 30 and 6 are connected to each other in the same manner as the members 8, 18 and 8 of the embodiment of FIG. 1. Like member 18, the member 30 is provided with a runner 19. The members 28, 29, 30 and 6 are provided with stops 23 and 24, again as in FIG. 1, but the stops are not shown in FIG. 6 for clarity of illustration. Furthermore, the same structural modifications as described with reference to FIGS. 4 and 5 may be made as to the last member 30 and member 6 of the downhole drive.

FIG. 7 shows a portion of FIG. 6 comprising some members 8 inside a contiguous casing or hose 35 which is effective to tightly hold the members 8 together, to protect them and especially the spaces therebetween, and to keep drilling fluids from flowing through the spaces between the members, if the interiors of the members 8 are used as a fluid conduit.

FIG. 8 is similar to FIG. 7 and shows sealing means in the form of a hose or casing 36. In the embodiment of FIG. 8, however, the hose 36 is disposed inside the members 8 and due to the fluid pressure is held in snug contact with the interior walls of the members 8, so that it will not be subject to tensional forces, as in the embodiment of FIG. 7.

What is claimed is:

1. A drilling tool for drilling curved sections of deep well holes by means of a drill bit operated by a downhole drive disposed at the downhole end of a drill pipe string which is secured against rotation, the angular deviation of the drill bit from the well axis being controlled by said drill pipe string, characterized in that a segment of the drill string is flexible in one plane only and comprises a series of generally-tubular individual link members pivotally connected to each other by means of pins, the next to the last link member of the downhole end of said drill string having a width dimension equal to the diameter of the drill bit, and means on the last link member of the drill string for controlling the pivotal position of said last member with respect to the penultimate member, said last member being located immediately adjacent the drill bit and forming a pivot bearing for said drill bit.

2. A drilling tool according to claim 1, characterized in that the means for controlling the deviation of said drill bit includes a sliding surface on the side of said last link member adjacent the outer rim of said curved section and spaced from the axis of said drill bit a distance greater than the radius of said drill bit.

3. A drilling tool according to claim 1, characterized in that the means for controlling the deviation of the drill bit comprises a pivot pin connecting said last member and said penultimate member which is located off center with respect to the longitudinal axis of said members, and a stop disposed between said two members to limit the pivotal movement caused by the eccentricity of the pivot axis in combination with the axial thrust of said drill bit.

4. A drilling tool according to claim 1, characterized in that the means for controlling the deviation of the drill bit comprises a pressure-exerting element disposed between said penultimate member and said last member, whereby a force is applied to said last member in the direction of said deviation.

5. A drilling tool according to claim 1, characterized in that said drill string link members are joined in an overlapping relationship in the regions of said pins.

6. A drilling tool according to claim 1, characterized in that said drill string link members are tightly joined to each other to form a conduit for drilling fluids.

7. A drilling tool according to claim 1, characterized in that the drill string link members include interfacing stops at their abutting surfaces to limit the angular movement of said members in the direction of the bend.

8. A drilling tool according to claim 1, characterized in that said pivotally-connected drill string link members are provided with cooperating stops to prevent movement of said members in a direction opposite to the direction of bend.

9. A drilling tool according to claim 1, which includes a downhole drive disposed between said flexible segment of the drill string and an adjacent substantially rigid portion of the drill string and is connected to said drill bit by a flexible drive shaft consisting of individual shaft members contained within each said link member and connected to each other by universal joints provided in the regions of said pivot axes between said link members.

10. A drilling tool according to claim 1, which includes a downhole drive disposed between said flexible segment and said drill bit.

11. A drilling tool according to claim 10, characterized in that said downhole drive consists of a plurality of motors mounted in link members of the flexible drill string segment, the drive shafts of said motors being interconnected by universal joints.

12. A drilling tool according to claim 6, characterized in that said members are provided with a hose at least in the regions of the areas of contact between adjacent members, said hose holding said members closely together.

13. A drilling tool according to claim 5 in which said overlapping regions comprise ears projecting from one link member over an adjacent link member and said pins extend through said ears, normal thereto.

* * * * *